US008882061B2

(12) United States Patent
Marsh

(10) Patent No.: US 8,882,061 B2
(45) **Date of Patent: *Nov. 11, 2014**

(54) SYSTEM AND METHOD FOR INCREASED FILLING OF PLASTIC GUSSETED T-SHIRT BAGS

(71) Applicant: Karl Marsh, Glendale, CA (US)

(72) Inventor: Karl Marsh, Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/850,122

(22) Filed: Mar. 25, 2013

(65) Prior Publication Data

US 2013/0330163 A1 Dec. 12, 2013

Related U.S. Application Data

(63) Continuation-in-part of application No. 12/882,045, filed on Sep. 14, 2010, now Pat. No. 8,424,816, which is a continuation-in-part of application No. 12/586,201, filed on Sep. 17, 2009, now abandoned.

(60) Provisional application No. 61/164,460, filed on Mar. 29, 2009.

(51) Int. Cl.

| | |
|---|---|
| ***B65B 67/04*** | (2006.01) |
| ***A47F 13/08*** | (2006.01) |
| *B65B 67/12* | (2006.01) |

(52) U.S. Cl.

CPC ..... *A47F 13/085* (2013.01); *B65B 2067/1294* (2013.01)

USPC ..... 248/100; 248/95; 248/99

(58) Field of Classification Search

USPC ..... 248/95, 97, 99, 100, 150, 175; 53/390; D34/6; 141/314, 390, 391

See application file for complete search history.

(56) References Cited

U.S. PATENT DOCUMENTS

| | | | | |
|---|---|---|---|---|
| 4,487,388 | A * | 12/1984 | Provan | 248/97 |
| 5,020,750 | A * | 6/1991 | Vrooman et al. | 248/97 |
| 6,042,063 | A * | 3/2000 | Kerr et al. | 248/100 |
| 8,424,816 | B1 * | 4/2013 | Marsh | 248/100 |
| 8,528,867 | B1 * | 9/2013 | Carmo | 248/97 |

* cited by examiner

*Primary Examiner* — Gwendolyn W Baxter

(74) *Attorney, Agent, or Firm* — Roy L. Anderson; Wagner, Anderson & Bright

(57) ABSTRACT

A bag rack and packing system for a plastic grocery bag having a pair of handles has a base to which is connected (1) a three-sided rack having a reservoir bag holder for plastic bags and two arms and (2) a three-sided support having two side supports and an intermediate back support, with each of the side supports having a forward upper tab close to the three-sided rack, an intermediate top and then a rearward edge. The three-sided rack and three-sided support have open faces that face each other so that the three-sided support temporarily creates a defined physical frame for a first plastic grocery bag when its handles are secured over the forward upper tabs of the two side supports. The forward upper tabs help separate an individual bag from a reservoir of bags and the individual bag may remain attached to, or be detached from, the reservoir of bags as it is being filled.

13 Claims, 8 Drawing Sheets

SYSTEM AND METHOD FOR INCREASED FILLING OF PLASTIC GUSSETED T-SHIRT BAGS

CROSS-REFERENCE TO RELATED APPLICATIONS

This application is a continuation-in-part of U.S. Ser. No. 12/882,045, filed Sep. 14, 2010, which itself is a continuation-in-part of U.S. Ser. No. 12/586,201, filed Sep. 17, 2009, which itself claims priority from U.S. patent application Ser. No. 61/164,460, filed Mar. 29, 2009, the disclosures of all of which are specifically incorporated herein by reference.

FIELD OF THE INVENTION

The present invention is in the field of plastic grocery bags and, more specifically, in the field of how they are dispensed and filled.

BACKGROUND OF THE INVENTION

Plastic Grocery Bags—The Beginning.

The plastic grocery bag, also known as a gusseted t-shirt bag, was first introduced 50 years ago. It became pervasive in supermarkets throughout the U.S. in the late 1970's. Today approximately 40,000 supermarkets utilize $1.3 billion worth of plastic grocery bags. Plastic grocery bags became an indispensable supply item for supermarket chains because they are so inexpensive relative to the main alternative—paper bags. Specifically, a plastic grocery bag is about ⅙th the cost of a paper bag. Because of this cost disparity the plastic grocery bag is now 85% of a supermarket's bag cost and paper bags, once the bag of choice, are now only 15%.

The cost disparity and resultant dominance in supermarket use of plastic grocery bags is important as background because it speaks to the philosophical view of supermarkets during the past few decades—"that even if 3 or 4 plastic grocery bags are used where previously one paper bag was used it is still less expensive than what we've been spending on paper bags".

Plastic Grocery Bag Issues—1970's.

Coinciding with this philosophy was the realization that plastic grocery bags were relatively weak especially along the bottom seal which could lead to heavy items falling through or sharp items ripping the bags. The consequence of such product failures were refunds to shoppers and general shopper dissatisfaction. The solution that evolved has been to significantly under fill a plastic grocery bag or "double bag" items. Unfortunately over time this behavior on the part of supermarket baggers has been taken to an extreme well beyond the true limitations of plastic grocery bags. Studies show that on average less than 50% of available volume of a standard plastic t-shirt bag is being utilized and 10% of supermarket usage is for double bagging.

The physical nature of plastic grocery bags has been a continual issue over the decades but for significantly differing reasons. Early on after their introduction one of the primary issues was how do you open and keep open a plastic grocery bag so groceries can be put inside. Paper bags had historically just been placed on the check out counter and because they had a fixed shape could, once open, be easily loaded. Plastic grocery bags by contrast didn't have a fixed shape and the film would stick together during and after opening so they were difficult to load and thus inefficient in a commercial retail setting.

Another problem, at that time, resulting from plastic grocery bags' tendency to stick to together was getting the "next" bag for packing without grabbing multiple bags at the same time. This problem led to both wasting a lot of bags and slowing down the checkout process.

Early Plastic Grocery Bag Industry Innovations/Inventions.

Because of these two issues early inventions regarding plastic-t-shirt bags centered on ways to effectively and efficiently grab, open and keep open a single plastic grocery bag during packing. Thus the wire-arm bag racks and self-opening plastic grocery bags that are now ubiquitous in supermarkets world-wide came to be. These, now industry standard, products ensure that plastic grocery bags are efficiently dispensed one bag at-a-time, opened wide and kept opened during loading.

Plastic Grocery Bag Issues—2009/Today.

What wasn't foreseen during the early days of plastic grocery bags' widespread use is how their relatively weak structure and disposable nature would lead to the tremendous underutilization, waste and environmental issues that are evident today. The carbon footprint, single-use and underutilization of plastic grocery bags are seen as a major issues by environmental groups, municipalities and concerned citizens—all looking for ways to curb or eliminate their use. Cities such as San Francisco have enacted laws and/or bag use taxes to accomplish just such reduced plastic grocery bag use.

Towards this end, inventions/innovations regarding plastic grocery bags today are now focused on reducing their underutilization, waste and negative environmental impact. For example, in regards to increasing the utilization of plastic grocery bags inventions such as the reinforced bottom seal have been introduced. This particular invention allows a plastic grocery bag to be completely filled, thus holding as much as a paper bag or reusable bag, without the bottom seal breaking or the bag ripping. This could potentially lead to a significant drop in plastic grocery bags used and plastic introduced into the environment.

Why Plastic Grocery Bags Remain Underutilized.

A limiting factor in the better utilization of plastic grocery bags during the bagging process is that they don't adequately take on and sustain an erect rectangular shape using the industry standard wire-arm bag rack. Specifically, plastic grocery bags sag during loading and start to look full before they actually, are full and thus the bagger pre-maturely halts packing the current bag and moves on to a new bag.

While one bag at-a-time dispensing, opening and general packing of a plastic grocery bag is no longer an issue, as its been adequately addressed with past inventions adopted by the industry (such as self-opening bags and wide armed wire racks), this issue of optimal packing/filling of a plastic grocery bag has not been sufficiently addressed commercially. The national average, at supermarket chains, for grocery items in a plastic grocery bag, is 3.4 items per bag. This is less than half of what goes into a paper bag of equivalent size. Many major retailers are now pushing to get their average items per bag up. For example, in their most recent sustainability reports, Kroger and Wal-Mart cite the desire to increase item count to 5 and reduce bag waste by 33%, respectively.

Most efforts to reduce bag waste in a retail setting have centered on training baggers to put more in every bag such as Kroger's current Strive for Five program. While these programs generally have initial success the results are difficult to sustain because supermarkets have high turnover in the bagger position, which is predominantly comprised of part-time employees who are very often high-school or college students.

Accordingly, there has been a long-felt need, that has not yet been met, for a more natural, effective and sustainable method to achieve increased items per bag so as to reduce bag waste.

SUMMARY OF THE INVENTION

The present invention is generally directed to a bag rack and packing system for a plastic grocery bag having a pair of handles which has a three-sided bag rack having a reservoir bag holder for plastic bags and two arms and a three-sided support having two side supports plus an intermediate back support and each of the side supports has a forward upper tab close to the three-sided bag rack, an intermediate top and then a rearward edge, the three-sided bag rack and three-sided support having open faces that face each other so that the three-sided support temporarily creates a defined physical frame for a first plastic grocery bag when its handles are secured over the forward upper tabs of the two side supports.

The efficiency of filling a plastic grocery is increased by extending the pair of handles of the plastic bag over a pair of forward upper tabs of a three-sided support so as to temporarily create a defined physical frame for the plastic grocery bag, then filing the plastic grocery bag, and removing it from the three-sided support.

Accordingly, it is a primary object of the present invention to provide an improved system and method for filling plastic grocery bags with bagged items.

This and further objects and advantages will be apparent to those skilled in the art in connection with the drawings and the detailed description of the preferred embodiment set forth below.

BRIEF DESCRIPTION OF THE DRAWINGS

FIG. 4 illustrates a standard wire bagging rack coupled with a support for plastic grocery bags in accordance with an earlier invention. The system of FIG. 4 illustrates an add-on for an existing standard wire bagging rack while

FIG. 6 illustrates a side view of a standard wire bagging rack in which a plastic grocery bag has been removed from a store of such bags and moved out onto side arms while

FIG. 9A illustrates a bag holder system in accordance, with an earlier invention, from a top view, in which a plastic grocery bag has been filled with the same three items shown in FIG. 8, while

FIG. 11 illustrates an improved embodiment of the system illustrated in FIG. 10 while

DETAILED DESCRIPTION OF THE INVENTION

Figure 1:
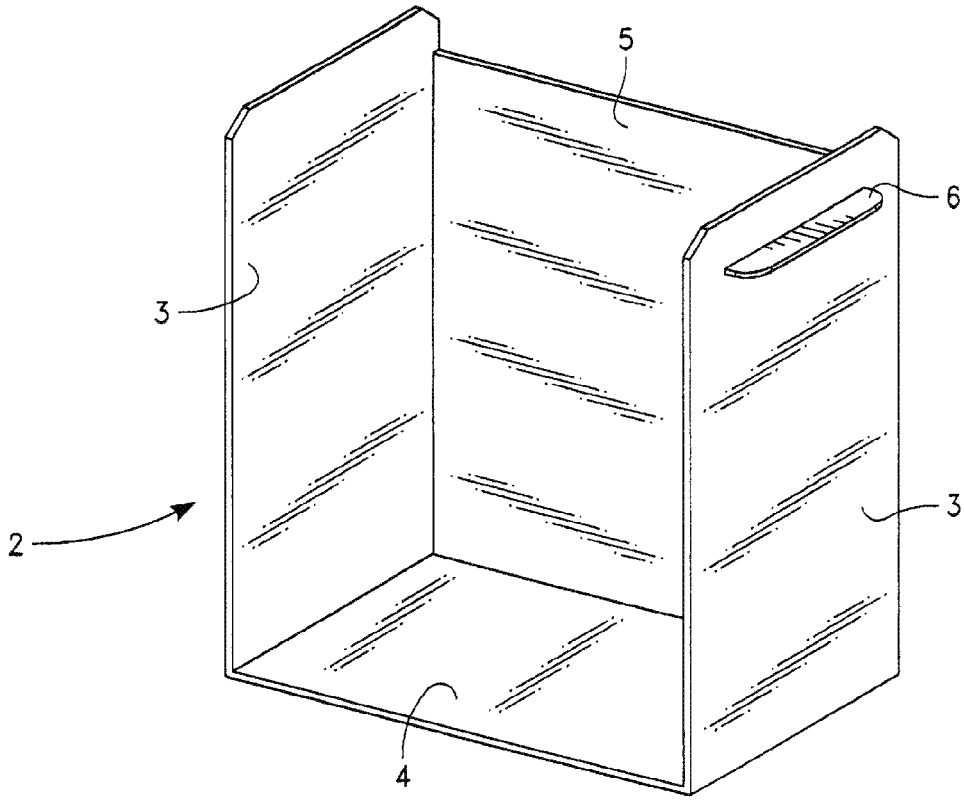
FIG. 1 illustrates a front view slightly offset at an angle of a support for plastic bags used in an earlier invention.

The present invention recognizes the current shift in issues related to plastic grocery bags and provides a system specifically and particularly designed to respond to the commercial and environmental need to reduce plastic grocery bag waste through more effective and efficient packing of plastic grocery bags. This system also recognizes a future in which plastic grocery bags such as those with reinforced bottom seals, are stronger than their historical counterparts and can be safely filled to capacity.

The present invention provides a plastic grocery bag system and method for supermarket chains/retailers to significantly increase items packed per bag, reduce the number of overall plastic grocery bags used and reduce the amount of plastic sourced and introduced into landfills (without sacrificing the convenient one bag at-a-time dispensing, self-opening & bagging ease currently enjoyed).

The present invention is an improvement over my prior invention described in Ser. No. 12/586,201, which is illustrated in FIGS. 1-5, 7, 9A and 9B, and the present invention will be described by reference to FIG. 10.

In the Figures and the following more detailed description, numerals indicate various features of the invention, with like numerals referring to like features throughout both the drawings and the description.

Although the Figures are described in greater detail below, the following is a glossary of the elements identified in the Figures.

1 plastic grocery bag holder system in accordance with a preferred embodiment of the present invention
1A plastic grocery bag holder system in accordance with a preferred embodiment of the present invention made of a single construction
2 3-sided support for plastic grocery bags
2A 3-sided support for plastic grocery bags in accordance with a preferred embodiment of the present invention made of a single construction
3 side support of 3-sided support 2
4 bottom support of 3-sided support 2
5 back support of 3-sided support 2
6 sidewall flap of 3-sided support 2
7 extended top of side support 3
8 corner of extended top of side support 3
9 open face of 3-sided support 2
11 base plate
11A base plate in accordance with a preferred embodiment of the present invention made of a single construction
12 hole for fastener
30 standard wire-arm bagging rack
30A standard wire-arm bagging rack incorporated into 1A
31 wire-arm of standard wire-arm bagging rack 30
32 reservoir bag holder of standard, wire-arm bagging rack 30
33 base of standard wire-arm bagging rack 30
34 plastic grocery bag
34A handle of plastic grocery bag 34
35 reservoir of plastic grocery bags
36 open face of standard wire-arm bagging rack 30
50 bagged item
51 filled plastic grocery bag of standard wire-arm bagging rack 30
52 filled plastic grocery bag of bag holder system 1
100 bag rack and packing system

Figure 4:
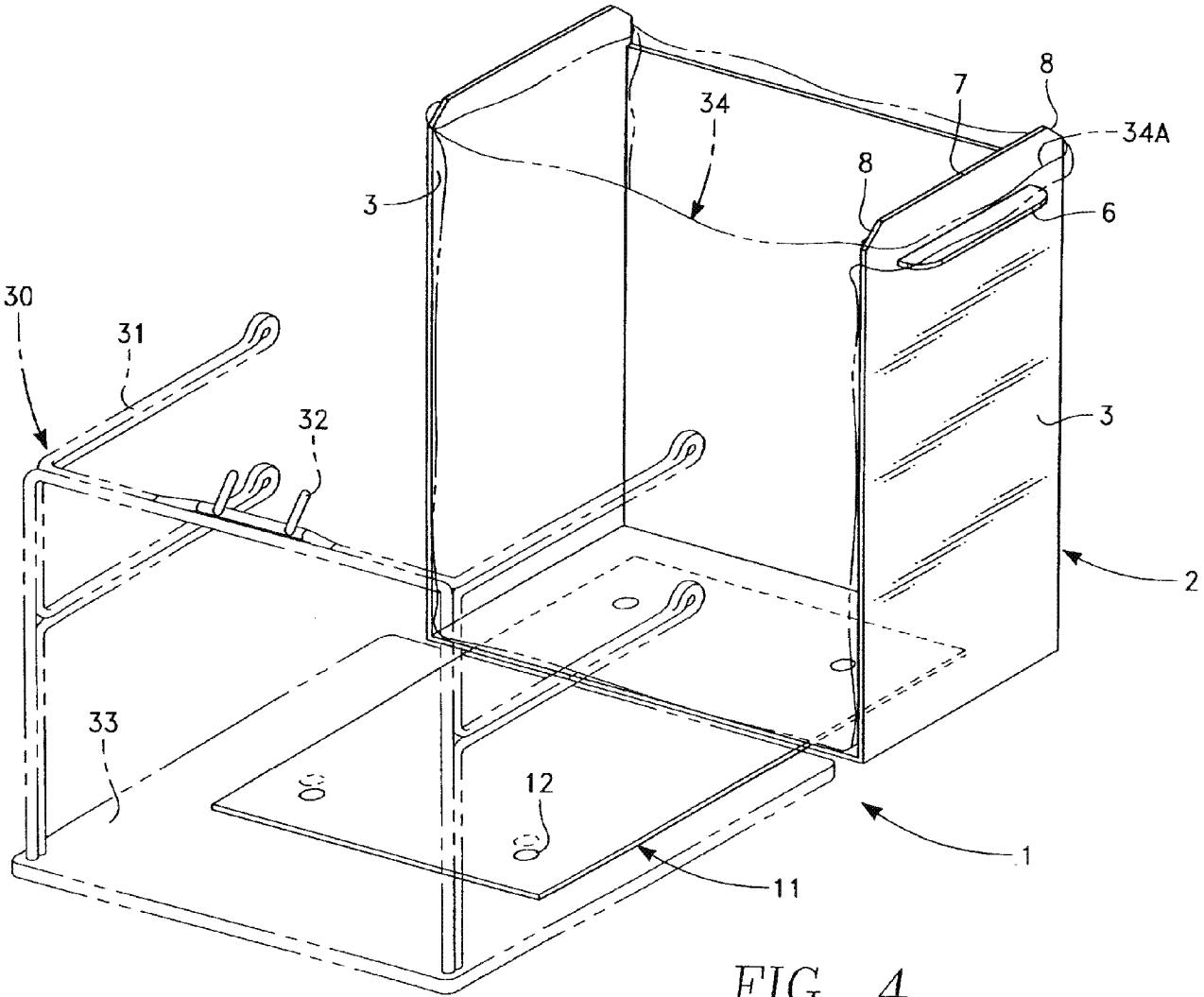

102 three-sided support
103 side support
103*f* front end of side support 103
105 back support
105A upper edge of back support 105
106 sidewall flap of three-sided support 102
109 open face of three-sided support 102
111 base plate
113 forward upper tab
114 intermediate top
115 rearward edge
130 wire-arm rack
131 wire-arm
132 reservoir bag holder
136 open face of wire-arm bagging rack 130
137 bag stability bar
137A inwardly facing catch of bag stability bar 137
200 center hook
201 cross beam A "standard wire-arm bagging rack" in common use throughout the United States today is illustrated in phantom in FIG. 4. The details of how a gusseted t-shirt bag 34 (hereinafter referred to as simply a "plastic grocery bag") is separated from a reservoir of plastic grocery bags 35 are not critical to the present invention except as they may relate to my improved system described later herein. A standard wire-arm bagging rack commonly has wire-arms 31, a reservoir bag holder 32, and a reservoir 35 of plastic grocery bags 34. The standard wire-arm bagging rack 31 functions to hold a reservoir of plastic grocery bags such that an individual plastic grocery bag can be easily removed from the reservoir, supported on wire-arms so as to hold the plastic grocery bag in an open position ready to be filled, filled, and then removed from open face 36. The standard wire-arm bagging rack may be placed on top of a base surface or have its own base 33. It is the type of rack that is commonly found at grocery stores or other retail stores where large volumes of items are bagged, hopefully quickly, by a checker or bagger.

My prior invention improved upon the standard wire-arm bagging rack 31 and how it is used by separating the function of the standard wire-arm bagging rack from the function of holding and filling plastic grocery bags. Instead of removing a plastic grocery bag from a reservoir and then filling it with bagged items while it is hanging from wire-arms, a system and method of filling plastic grocery bags in accordance with my prior invention removed a plastic grocery bag from a plastic grocery bag reservoir, then removed the plastic grocery bag from the wire-arms of the standard wire-arm bagging rack through open face 36, placed the removed plastic grocery bag over a 3-sided support for plastic grocery bags 2, and then filled the plastic grocery bag with bagged items 50 while it was supported separate and apart from the standard bagging rack.

My prior invention, by integrating a three-sided support 2 with a standard wire-arm rack 30, temporarily created and sustained, for a plastic grocery bag, during the packing process, a defined physical frame (rectangle, circle, square, triangular, irregular etc.) that facilitated optimal full-capacity loading resulting in: 1) increased items per bag packed and/or a more complete filling of the bag, 2) a reduction in overall bags used per transaction and 3) the ability to easily pack items in a stacked manner to the top of the bag. By accomplishing these three things my prior invention was a significant contributor to reducing the amount of plastic needed in the retail supply chain and the amount of plastic going into landfills.

Important to the success of my prior invention was that the erect bag shape during bagging gave the bagger a very accurate perception of how full (or empty) the bag truly was (similar to the experience of filling a fixed shape paper or reusable bag) and led to a natural complete filling of a bag because an unfilled bag would now LOOK "empty" and thus it would belie common sense to stop filling it and start to fill a new one.

Figure 2:
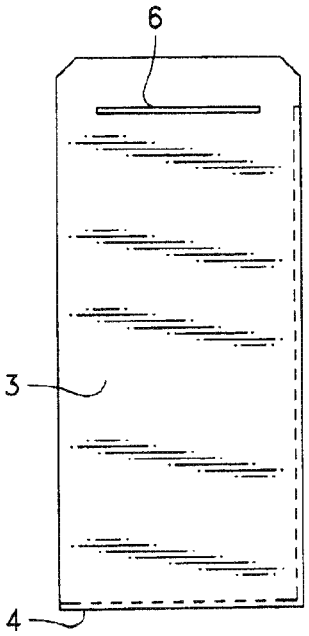
FIG. 2 illustrates a side view of the support of FIG. 1.
Figure 3:
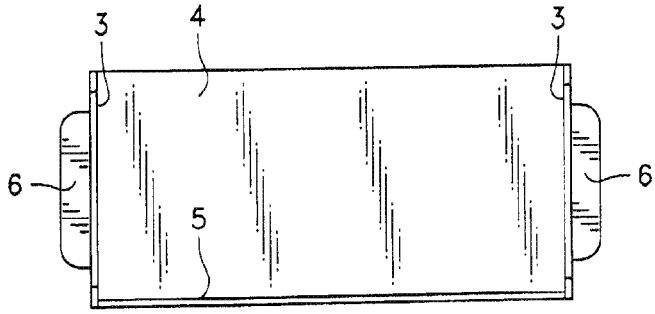
FIG. 3 illustrates a top view of the support of FIG. 1.
Figure 9A:
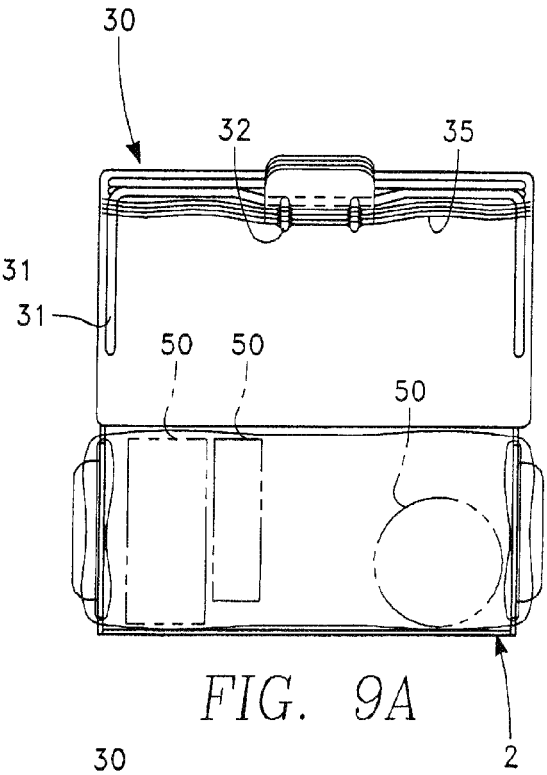
Figure 9B:
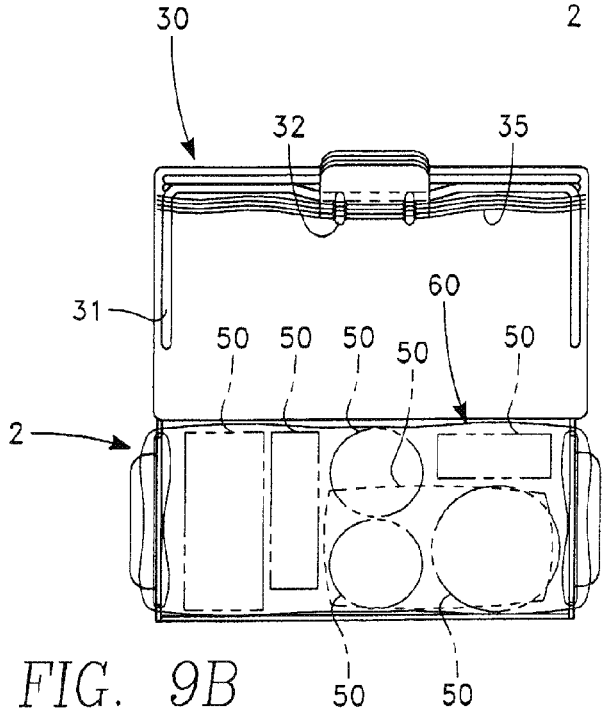
FIG. 9B illustrates additional items added to the bag holder illustrated in FIG. 9A. The dashed item in FIG. 9B represents an additional overlying lying on top of other items.

A 3-sided support for plastic grocery bags 2 in accordance with a preferred embodiment of my prior invention had a bottom support 4, two side supports 3 and a back support 5 located between the two side supports 3. One such 3-sided support 2 is shown in FIGS. 1-3. Although side, bottom and back supports 3-5 are shown in FIGS. 1-3 as solid, they need not be. For example, they could be perforated or have some other type of non-continuous surface so as to save on material costs (see, e.g., FIG. 10). The important thing was not the shape or absolute solidness of such supports, but that they function so as to support a filled plastic grocery bag 52 as illustrated in FIGS. 9A and 9B and described hereinafter. The two side supports 3, back support 5 and bottom support 4 provided a three-sided structure with a bottom support which allowed a plastic grocery bag 34 to be opened to a full extent (as shown in FIGS. 4, 7, 9A and 9B) and supported in such position while it was being filled with bagged items 50.

Each side support 3 had a sidewall flap 8 and extended top 7. The corners 8 of extended tops 7 were preferably either rounded or angled (as shown in FIG. 4) to avoid sharp edges otherwise associated with a ninety degree corner. Side supports 3, in an especially preferred embodiment, were made of two pieces attached through a mechanism such as an adjustable lock pin or sleeve design (not shown in the Figures) that allowed the height of extended tops 7 to be adjusted to accommodate various bag dimensions.

Figure 8:
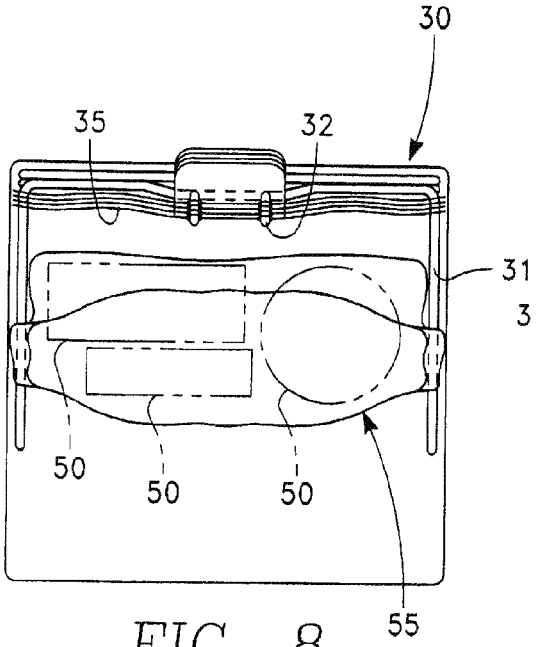
FIG. 8 illustrates a standard wire bagging rack, from a top view, in which a plastic grocery bag has been filled with three items and looks full.

Handles 34A of plastic grocery bag 34 (with or without a reinforced bottom seal) were extended over extended tops 7 of 3-sided support 2 down to sidewall flaps 6 prior to packing it with contents. By extending handles 34A over extended tops 7 down to sidewall flaps 6, a wide opening was created and the body of the plastic grocery bag took on an erect, rectangular "paper bag shape" to maximize ease of packing and stimulate a natural increased filling of the bag resulting in more items per bag and less bags used. This rectangular shape was now a cavity visually that would naturally and intuitively stimulate an increased/complete filling of the bag (versus the previous method) resulting in more items per bag and less bags used. Baggers could now simply pack plastic grocery bags in the same manner they would a paper bag because a person filling the plastic grocery bag could visually see that it had more room for additional bagged items (see FIG. 9A) and the bagged items were themselves supported by support 2. The result was a filled plastic grocery bag 52 (see FIG. 9B) that had more bagged items than a filled plastic grocery bag 51 of a standard wire-arm bagging rack 30 (see FIG. 8)

Thus, by adding the 3-sided support 2 to existing wire-arm racks 31 and just training baggers how to place the bags onto the 3-sided support 2 retailers could, with my prior invention, naturally get and sustain significantly increased filling of EVERY plastic grocery bag.

My prior new method for packing a plastic grocery bag allowed retailers to reduce bag waste (and potentially bag cost) by at least 25% (assuming an increase of 1 item per bag over the national average of 3.4 items per bag) and potentially as much as 50% (assuming 50% under-utilization currently) if complete filling of the bag was achieved (which was possible and desirable with new plastic grocery bags such as the reinforced bottom seal t-shirt bag). In dollar terms this could mean $250-$500 million in annual bag cost savings industry-wide.

Additionally, fewer bags used also meant lower distribution costs and more valuable storage space for a retailer. Shopper satisfaction would also increase because they had less bags to carry for each shopping trip.

In sum, my prior invention was an innovative pro-business, pro environment solution that enabled plastic grocery bag manufacturers, retailers and shoppers to do the right thing in achieving a workable solution to the "plastic grocery bag" problem.

Because there are a great many standard wire bagging racks 31 in common use today, it was important that my prior invention could be adapted for use with such racks 31 to provide a legacy solution that did not require existing standard wire bagging racks to be replaced. This goal was achieved by use of an add-on system which was illustrated in FIG. 4. A base plate 11 was used to connect a support for plastic bags 2 to a standard wire bagging rack 30. The base plate could be fastened to support 2 and bagging rack 30 by fasteners (not shown) through holes 12. The critical point here was not how support 2 and bagging rack 30 were fastened or held together, but that they were arranged and aligned directly opposed from each other so that open face 36 and open face 9 were directly opposite of one another to form a plastic grocery bag holder system 1 as shown in FIG. 4. In other words, once a plastic grocery bag was removed from reservoir plastic grocery bag holder 32 of bagging rack 30, the plastic grocery bag was moved off of arms 31 through open face 36 and then directly moved into open face 9 where it was secured about extended tops 7 and sidewall flap 6 of support 2 in a quick, fluid movement that should not significantly slow down the bagging process.

Figure 5:
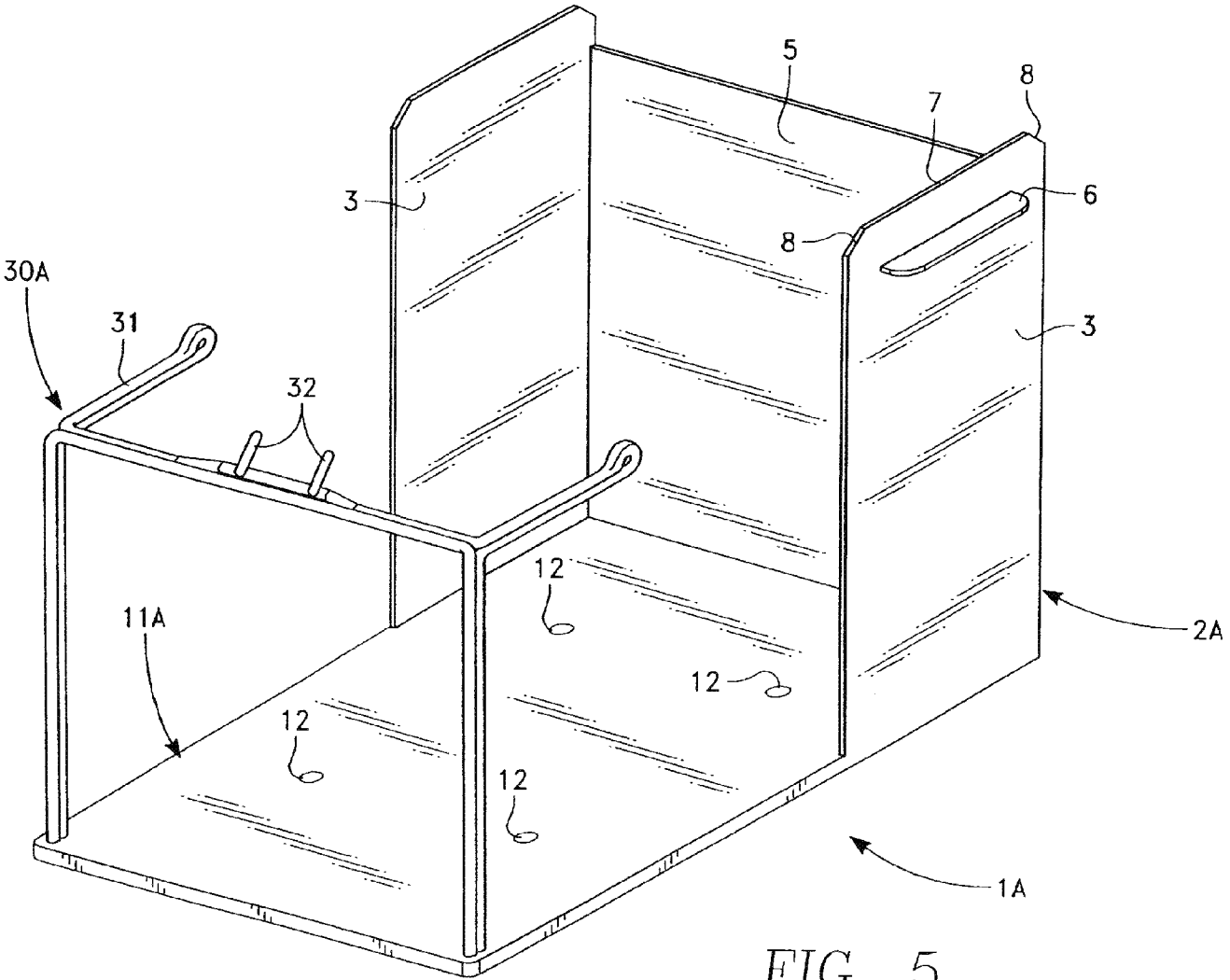
FIG. 5 illustrates the same type of overall system constructed in a single unit.
Figure 7:
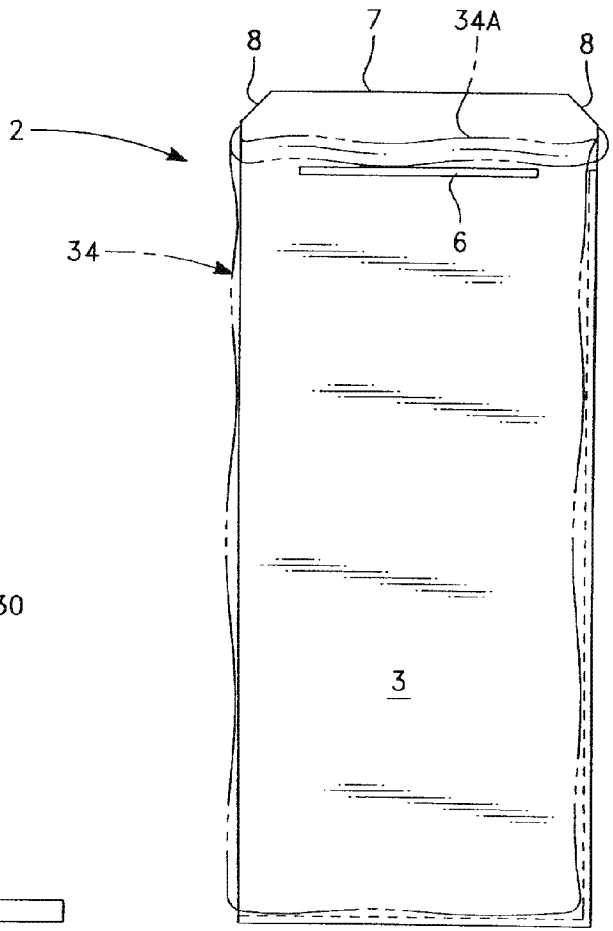
FIG. 7 illustrates a side view of a support for plastic grocery bags used in a preferred embodiment of the present invention with a plastic grocery bag being (shown in phantom) being supported.
Figure 6:
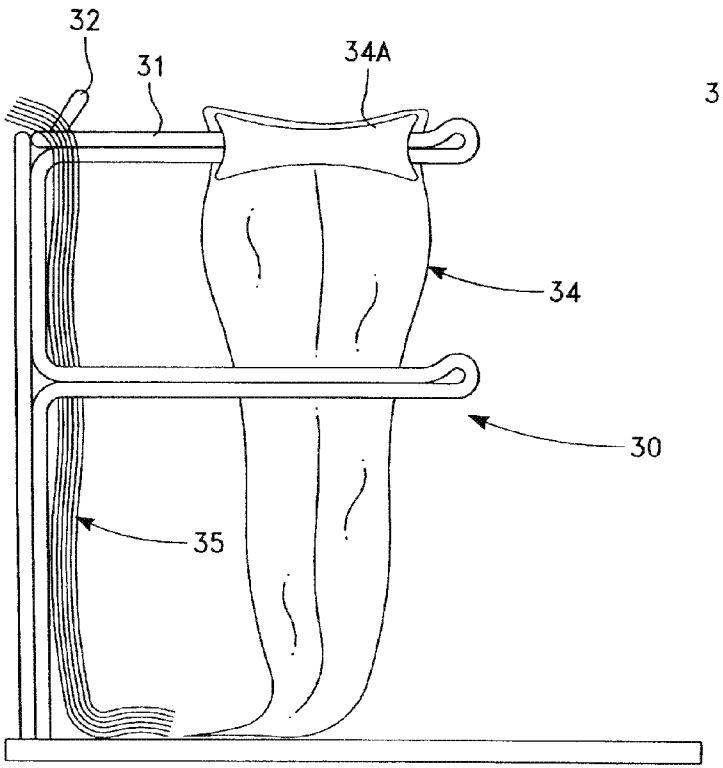

When one was not confronted with a legacy system involving preexisting standard wire bagging racks 30 (e.g., in a new store or expansion of check-out lines in an existing store), one could use a plastic grocery bag holder system 1A, a preferred embodiment of my prior invention which was illustrated in FIG. 5. Plastic grocery bag holder system 1A had a standard bagging rack 30A, base plate 11A and support 2A all incorporated into a single, integral construction. Plastic grocery bag holder system 1A had similar structure and function as plastic grocery bag holder 1, the only difference being that it was designed and constructed as a single construction (with different parts) as opposed to requiring retrofitting necessary to combine two separate structures, bagging rack 30 and support 2.

Figure 10:
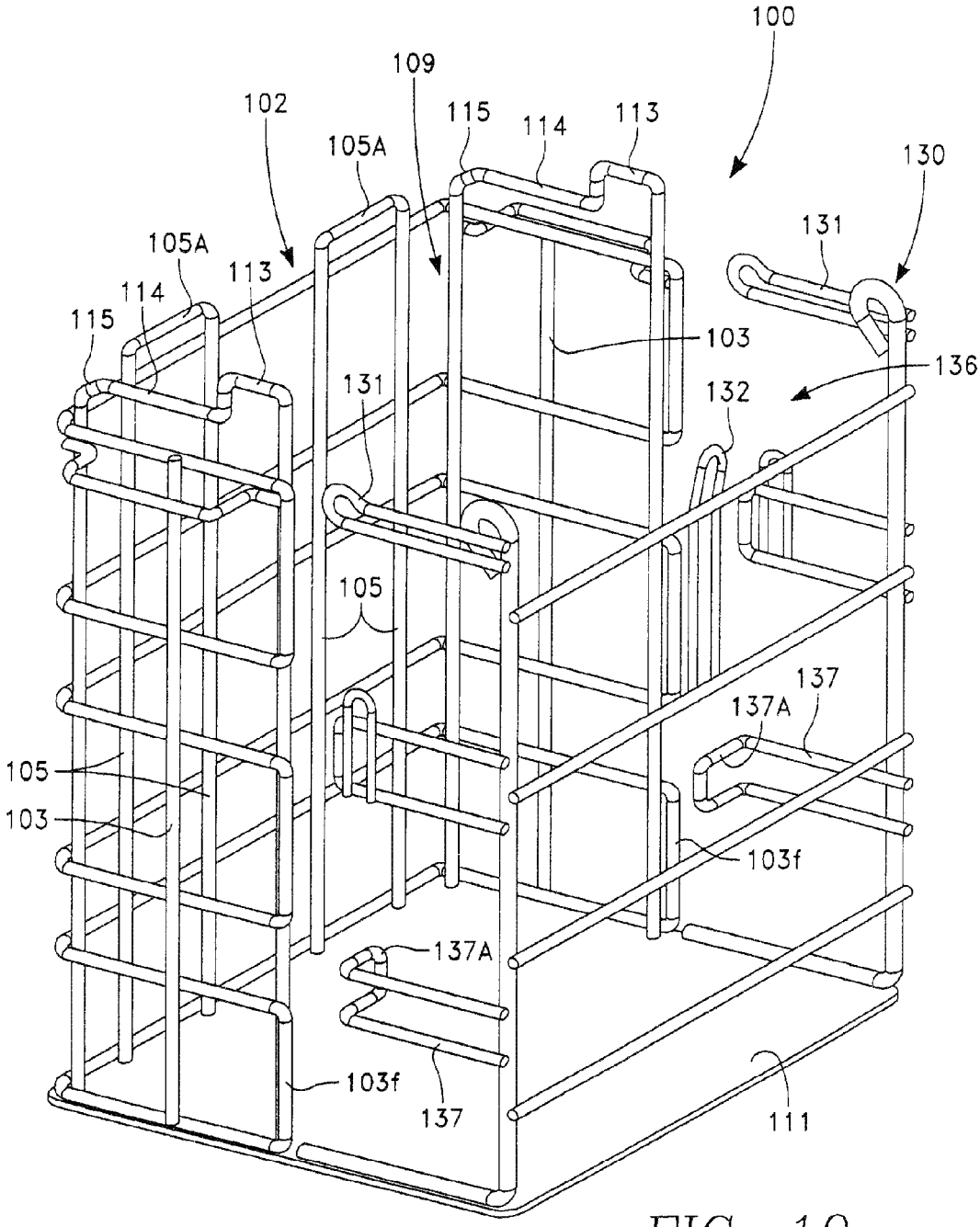
FIG. 10 illustrates a preferred embodiment of the present invention.
Figure 11:
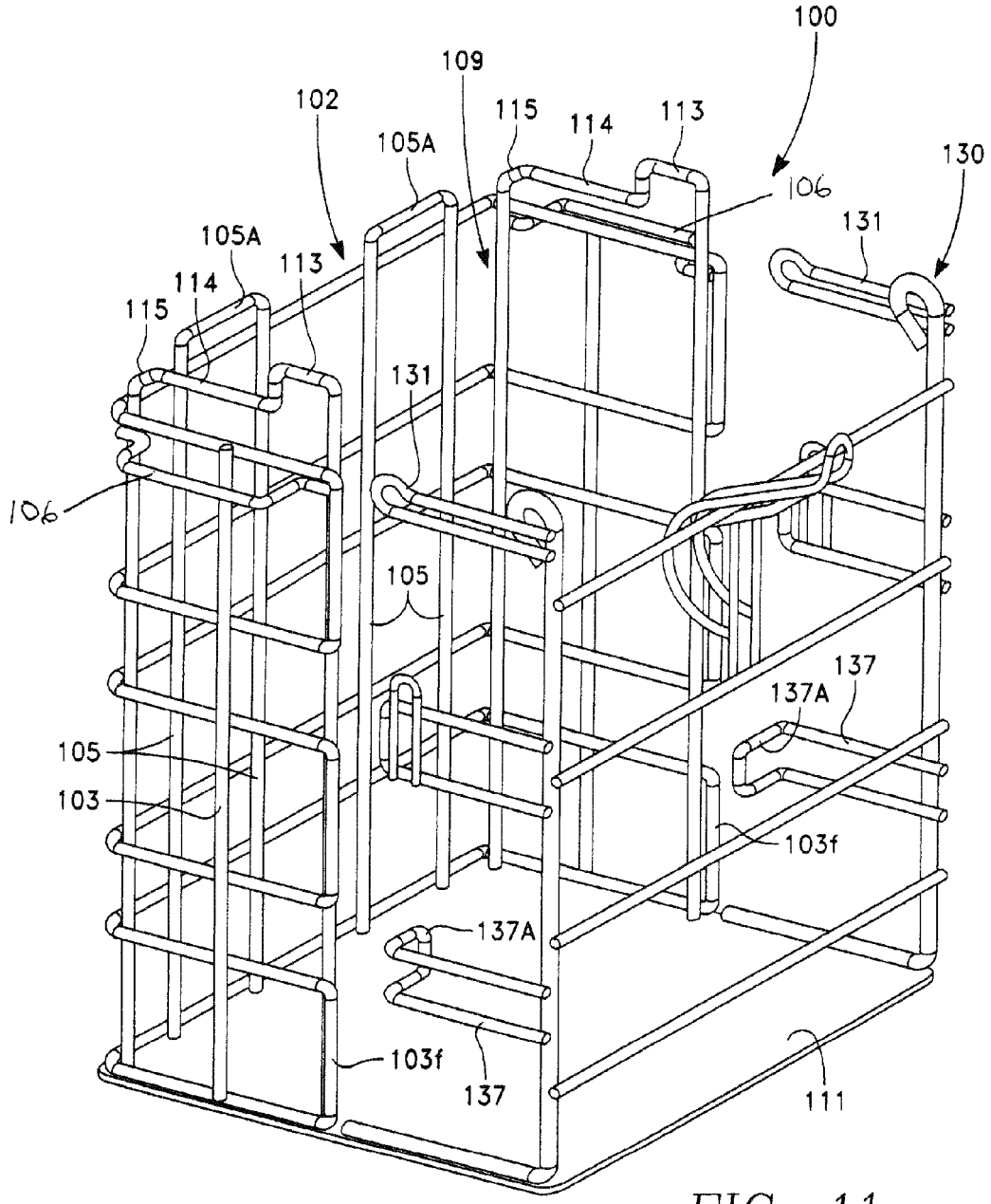

I previously invented a new plastic grocery bag holder system that is an improvement over my original invention and which justifies replacement of current bagging systems so as to achieve the benefits of my invention, hereinafter described. This new bag rack and packing system 100 is illustrated in FIG. 10. To save on material costs it is illustrated as being made of wires, although it could certainly be made of solid materials, if one is willing to pay a higher material cost.

Bag rack and packing system 100 has a base plate 111 to which are attached a wire-arm rack 130 and a three-sided support 102.

Wire-arm rack 130 has wire-arms 131 that are shorter than traditional wire-arms 30, a reservoir bag holder 132 and bag stability bars 137.

Three-sided support 102 has two side supports 103 connected by a back support 105. Each of the two side supports 103 has a front end 103*f* that is closest to wire-arms 131 and bag stability bars 137. The top of front end 103*f* (i.e., the portion furthest from base plate 111) forms a forward upper tab 113 that then drops down to an intermediate top 114 which then drops down to rearward edge 115 which is proximate back support 105.

When bag rack and packing system 100 is used, a bag packer (a.k.a. a bagger) will usually stand behind back support 105 relative to wire-arm rack 130. The bagger will pull a bag from reservoir bag holder 132 and pull its two handles up over the two forward upper tabs 113 and then over an upper edge 105A of back support 105 (which can be a solid edge or multiple edges, as shown in FIG. 10, in which there are two edges). Sidewall flaps 106 of side supports 103 serve as a resting point for the handles of a bag when it is placed on three-sided support 102 and is ready to be filed to help sustain an erect bag shape and prevent it from sinking. Because the two handles of the bag hook over forward upper tabs 113 while the bag is still attached to the bag reservoir, forward upper tabs 113 serve the function of helping to efficiently open a single bag from a reservoir of bags. It is important that forward upper tabs 113 not be too high, since that will force the bag to have to be lifted up over them after packing, but they also cannot be too low, or they will not grab the bag handles. (And, in a less preferred embodiment, forward upper tabs 113 can be entirely removed, although this embodiment will not function as well.)

Once the bag has been filled, rearward edges 115 help the bag to be efficiently removed from bag rack and packing system 100. It has been found that it is especially preferred that rearward edges 115 be beveled since such a shape allows for fast, easy removal, and speed is a critical issue in bagging. (It has also been found that not having a sloped rearward edge, in other words just having a straight up and down edge, makes a filled bag too hard to remove, whereas using a curved or rounded rearward edge allows the bag to come off too easily during the packing process.)

My prior improved invention will now be described in even greater detail by setting forth the dimensions of an especially preferred embodiment. Such dimensions are not meant to be limiting of the scope of the present invention, but to be illustrative and also to provide the best mode currently known for practicing the present invention.

In this especially preferred embodiment, base plate 111 is twelve inches by twelve inches. This is especially preferred because it allows back rack and packing system 100 to fit into the same cube currently used for standard wire-arm bagging racks 30. Wire-arms 131 are parallel to, and 10% inches above, base plate 111, while bag stability bars 137 are 3⅜ inches above base plate 111. Both wire-arms 131 and bag stability bars 137 are 4 inches long and there is a 2 inch gap between them and front end 103*f*. Bag stability bars 137 have an inwardly facing catch 137A that is 1½ inches long. Front end 103*f* is approximately 15 inches high off of base plate 111. Forward upper tabs 113 are one inch long and then drop 1¼ inches to intermediate tops 114 which then run 4½ inches until beveled rearward edges 115 drop another ½ inch with a 45 degree bevel.

This especially preferred embodiment has additional advantages over a standard wire-arm bagging rack 30 because, even though its wire-arms 131 are shorter than standard wire-arms 31, they can be packed full of bags (which bag stability bars 137 help keep in place), which means they can hold twice the number of bags (including the same type of bags now being used) and this saves loading time and labor costs.

Now I have invented an additional improvement to the new plastic grocery bag holder system disclosed in my prior patent application, U.S. Ser. No 12/882,045.

Figure 12:
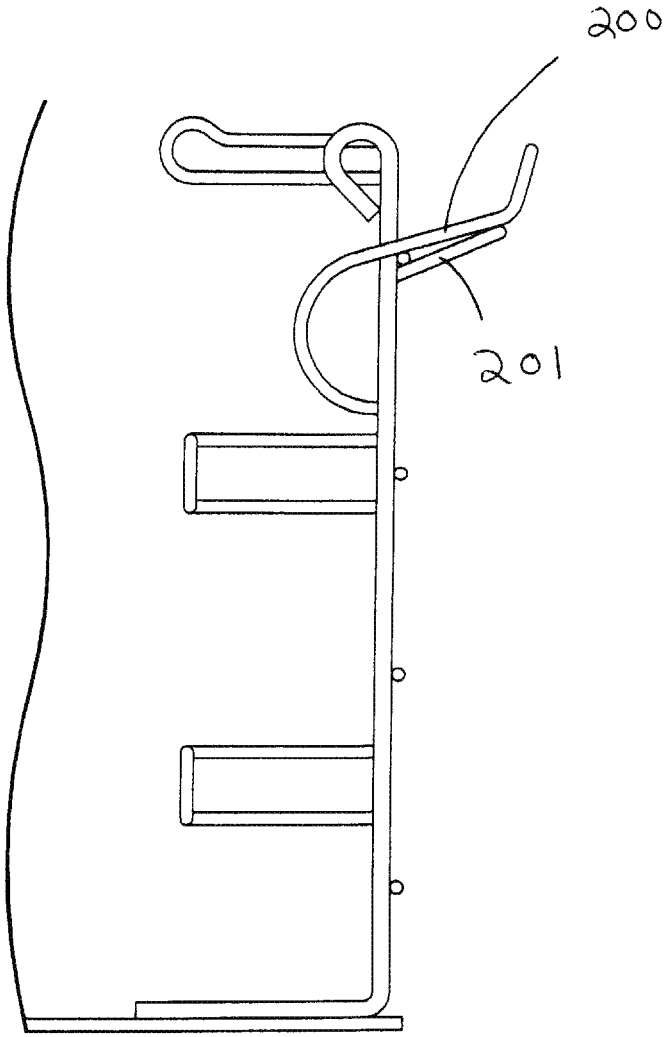
FIG. 12 is a detailed side view of the change between FIG. 10 and FIG. 11.

In my new improvement, the reservoir bag holder of FIG. 10 is extended behind/beyond the loading wall a sufficient distance which is adequate to restrain every bag loaded onto rack 130 from inadvertently coming off the rack when preceding bags are detached during packing process. Center hook 200 also has a wider cross beam 201 underneath it (see FIG. 12) to prevent bags from slipping towards back support 105.

While the invention has been described herein with reference to certain preferred embodiments, those embodiments have been presented by way of example only and not to limit the scope of the invention. Thus, for example, either or both of the three-sided bag rack and its opposing three-sided support might be made of solid materials, be attached or not together and/or to a base, or have portions of them affixed to walls of a bag loading area. Additional embodiments and further modifications are also possible in alternative embodiments that will be obvious to those skilled in the art having the benefit of this detailed description.

Accordingly, still further changes and modifications in the actual concepts described herein can readily be made without departing from the spirit and scope of the disclosed inventions as defined by the following claims.

What is claimed is:

1. An apparatus useful with a plastic grocery bag having a pair of handles, comprising:

a three-sided bag rack comprised of a reservoir bag holder for a plurality of plastic bags and two side arms, said three-sided bag rack having an open face from which a first plastic grocery bag can be removed so as to extend it outwardly from the reservoir bag holder; and a three-sided support positioned opposite the three-sided bag rack in a horizontal direction comprised of two side supports and an intermediate back support so as to form a second open face, each of said two side supports having a forward upper tab, a rearward edge and an intermediate top located between the forward upper tab and the rearward edge, said rearward edge being more proximate the intermediate back support than the forward upper tab;

wherein the first open face and the second open face are aligned opposite of each other in the horizontal direction;

wherein the three-sided support is constructed so as to temporarily create a defined physical frame for the a first plastic bag when the pair of handles of the first plastic grocery bag are removed from the two side arms and are extended and secured over the two side supports; and wherein the forward upper tab is more distant from a plane located below the three-sided bag rack and the three-sided support than the intermediate top and the rearward edge drops from the intermediate top toward the plane.

2. The apparatus of claim 1 wherein the three-sided bag rack and the three-sided support are separately attached to a base.

3. The apparatus of claim 1 wherein the three-sided bag rack and the three-sided support are located above and detached from a base.

4. The apparatus of claim 1 wherein the three-sided bag rack and the three-sided support are attached to each other.

5. The apparatus of claim 1 wherein the three-sided bag rack and the three-sided support are not attached to each other.

6. The apparatus of claim 1 wherein the two side arms are not attached to the reservoir bag holder.

7. The apparatus of claim 1 wherein the two side arms are attached to the reservoir bag holder.

8. The apparatus of claim 1 wherein the two side supports are connected to the intermediate back support.

9. The apparatus of claim 1 wherein the two side supports are not connected to the intermediate back support.

10. The apparatus of claim 1 wherein the reservoir bag holder is further comprised of a center hook which extends behind a loading wall a sufficient distance for restraining the plurality of plastic bags from coming off the center hook when a first bag is removed from the plurality of bags and the three-sided bag rack.

11. A method, comprising the steps of:

pulling a plastic grocery bag with a pair of handles from a plastic grocery bag reservoir of a three-sided bag rack;

removing the pair of handles from two side arms of the three-sided bag rack through an open face of the three-sided bag rack;

extending and securing the pair of handles over a pair of handle supports so that the plastic grocery bag is held and sustained in an erect bag shape defined by a physical frame of a three-sided support, said three-sided support having a second open face opposite the open face in a horizontal direction; and placing one or more bagged items within the plastic grocery bag while the plastic grocery bag is being supported separate and apart from the three-sided bag rack.

12. The method of claim 11 wherein the plastic grocery bag is removed from a plurality of plastic grocery bags retained by a center hook of the plastic grocery bag reservoir.

13. The method of claim 11 wherein movement of the pair of handles is stopped by a pair of sidewall flaps of the three-sided support so that the pair of handles rests on the pair of sidewall flaps.

* * * * *